US006732650B2

(12) United States Patent
Rauh

(10) Patent No.: US 6,732,650 B2
(45) Date of Patent: May 11, 2004

(54) DEVICE FOR PROVIDING A CYLINDER WITH A PACKING AND REGISTERS

(75) Inventor: Volker Gerold Rauh, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/257,971

(22) PCT Filed: Apr. 4, 2001

(86) PCT No.: PCT/DE01/01307

§ 371 (c)(1),
(2), (4) Date: Oct. 28, 2002

(87) PCT Pub. No.: WO01/83215

PCT Pub. Date: Nov. 8, 2001

(65) Prior Publication Data

US 2003/0101886 A1 Jun. 5, 2003

(30) Foreign Application Priority Data

Apr. 28, 2000 (DE) ..... 100 20 910

(51) Int. Cl.[7] ..... B41F 27/12
(52) U.S. Cl. ..... 101/415.1; 101/378
(58) Field of Search ..... 101/415.1, 378, 101/382.1, 383, 384, 481, 485, 486, DIG. 36

(56) References Cited

U.S. PATENT DOCUMENTS 4,557,196 A * 12/1985 Kobler ..... 101/415.1
5,156,091 A 10/1992 Bätz
5,186,108 A * 2/1993 Hillebrand ..... 101/415.1
5,327,832 A 7/1994 Fischer
5,379,694 A 1/1995 Haek et al.
5,419,248 A 5/1995 Brotzman
6,382,103 B1 5/2002 Rauh
6,443,065 B1 * 9/2002 Charette et al. ..... 101/415.1
6,578,484 B2 * 6/2003 Fusco ..... 101/415.1

FOREIGN PATENT DOCUMENTS

| | | | |
|---|---|---|---|
| DE | 42 41 588 | C2 | 11/1994 |
| DE | 196 00 071 | C1 | 5/1997 |
| DE | 197 57 895 | A1 | 7/1999 |
| DE | 197 57 895 | C2 | 10/1999 |
| EP | 0 490 179 | A1 | 6/1992 |
| EP | 0 535 502 | B1 | 4/1997 |

* cited by examiner

*Primary Examiner*—Leslie J. Evanisko
(74) *Attorney, Agent, or Firm*—Jones Tullar & Cooper P.C.

(57) ABSTRACT

A cylinder can receive one or more packings which are held in proper register. One or more register elements are carried by support strips which are placed in the cylinder barrel. These register elements can be held against longitudinal displacement in the cylinder barrel by a clamping device that is operable from the end face of the cylinder. The clamping device includes a clamping assembly which is useable to hold the register elements in place.

31 Claims, 2 Drawing Sheets

DEVICE FOR PROVIDING A CYLINDER WITH A PACKING AND REGISTERS

FIELD OF THE INVENTION

The present invention is directed to devices for placing a registry-stable packing on a cylinder. At least one register block is placed in a groove in the cylinder. The block is held in position by an externally accessible clamp.

BACKGROUND OF THE INVENTION

A lateral registry system for printing formes in an axis-parallel gap of a forme cylinder in a rotary printing press is known from DE 42 41 588 C2. Cutouts at the beveled or angled ends of the printing forme act together with register pins that are arranged in the cylinder gap. The register pins are rigidly connected with insertion strips, which strips can be individually axially displaced, and which are arranged axis-parallel and above each other in the cylinder gap or groove, in respect to each other and in relation to the cylinder. The displacement of the insertion strips is performed for the purpose of accomplishing lateral adjustment of the printing forme by use of threaded bolts that are arranged at the end face of the cylinder, and whose thread length defines the displacement distance.

In a similar way DE 197 57 895 C2 shows a register setting arrangement, but in which the insertion strips are arranged next to each other in the cylinder gap. An increase of the setting range takes place by the provision of intermediate positions between the strip and the supports of the screw arranged on the front face.

EP 0 490 179 A1 discloses a register element which is releasably arranged on an insertion strip and which is displaceable in relation to the insertion strip fixed on the cylinder by use of eccentric bolts. The register adjustment is kept within the range of the eccentricity of the bolts. For fixation of the register element in place against unintentional displacement, the register element, which is provided with elongated holes, is maintained frictionally connected to the bottom of the insertion strip by the use of screws. Releasing and clamping, as well as adjustment of the register element, is performed from the direction of the cylinder shell through the groove opening. Releasing and clamping of a register element takes place in a similar way in EP 0 535 502 B1, radially by the use of screws, which are embedded in the insertion strips that are matched to the curvature of the cylinder shell.

DE 196 00 071 C1 discloses a device for placing a registry-stable packing on the shell surface of a cylinder. Clamping of register blocks takes place, extending from the shell surface, by the friction between the end of the register block itself, which is embodied as a conical seat, and a recess in a base body that is fixed in place on the cylinder body. The register blocks can be inserted discontinuously in the axial direction into various recesses, or base bodies in the cylinder.

A device is known from U.S. Pat. No. 5,419,248, in which substantially ring-shaped register elements are seated, in a freely rotatable manner, on an actuating shaft of a clamping device. Each can be frictionally fixed in place in a groove of the actuating shaft by a spreading device which can be operated from the groove.

SUMMARY OF THE INVENTION

The object of the present invention is directed to providing devices for accomplishing the registry-stable placement of a packing on a cylinder.

In accordance with the present invention, the object is attained by the use of at least one register block that is placed in a cylinder to which the packing will be secured. The position of the register block longitudinally in the cylinder can be changed. A clamping device is used to fix the register block in a desired longitudinal position in the cylinder barrel. The clamping device can be actuated from outside of a printing area of the barrel of the cylinder to change the position of the register block. The longitudinal position of the register block can be changed by an amount that is equal to at least one half of the width of the packing secured to the cylinder.

The advantages which can be achieved by the present invention reside, in particular, in that a variable arrangement and number of register elements can be arranged in a groove over almost the entire width of a cylinder barrel, or variably within the groove over the width of the printed material web or of the printing forme, regardless of whether there is a printing press with two, four or even more printing plates, or printing sides, arranged next to each other in the longitudinal direction of the cylinder.

The axial regulating distance for the register blocks is independent of an axial regulating distance of a regulating spindle or of a clamping device which can be operated from the front or end face of the cylinder, and is not fixedly connected with the cylinder.

The continuous regulating distance, which can be used over almost the entire length of the barrel of the cylinder, or over the width of the printing forme, makes possible, in addition to an adjustment within a narrow regulating range, a rapid reconfiguration of the register elements to other web widths of the paper or to other printing formats, for example, by simple displacement, without new elements needing to be inserted. The relative, axis-parallel, and independent displacement of two or more of the register elements, in respect to each other, is also of particular advantage. Particularly advantageous is the simple press- or customer-specific positioning and configuration of the register elements of the present invention in situ, without having to take narrow basic regulating ranges into consideration in the course of the manufacture, or assembly, of the grooves, even in the situation of different series or models.

For special embodiments, the shaping and dimensions of the device for placing a register-stable packing on a cylinder in accordance with the present invention can be matched, in a simple manner, to cylinder groove geometries or to register devices of existing printing presses, so that retrofitting or refitting are possible. Also, in connection with previously assembled presses, the exchange of register elements of various dimensions, their removal, or the additional equipping with them is possible.

It is particularly advantageous, in connection with cylinders having narrow, axially extending grooves for receiving printing formes, that clamping, or releasing of the register elements takes place from outside of the printing area of the barrel, for example, from the direction of the front or end face of the cylinder. The opening of the groove in the circumferential direction of the forme receiving cylinder can be kept as narrow as required for inserting printing formes, for example, without having to take into consideration the provision of access to fastening or adjusting devices, which previously have had to be accessible through the groove. The gap width is independent of tools or other devices needed for actuating the clamping device. The disruption of the shell surface of the cylinder, and therefore a limitation or a reduction of the printing area of the cylinder, for example by the need for embedded screws that are spaced apart from the groove in prior devices, is avoided by the device for placing a register-stable packing on a cylinder in accordance with the present invention.

BRIEF DESCRIPTION OF THE DRAWINGS

A preferred embodiment of the present invention is represented in the drawings and will be explained in greater detail in what follows.

Shown are in.

DESCRIPTION OF THE PREFERRED EMBODIMENT

Figure 1:
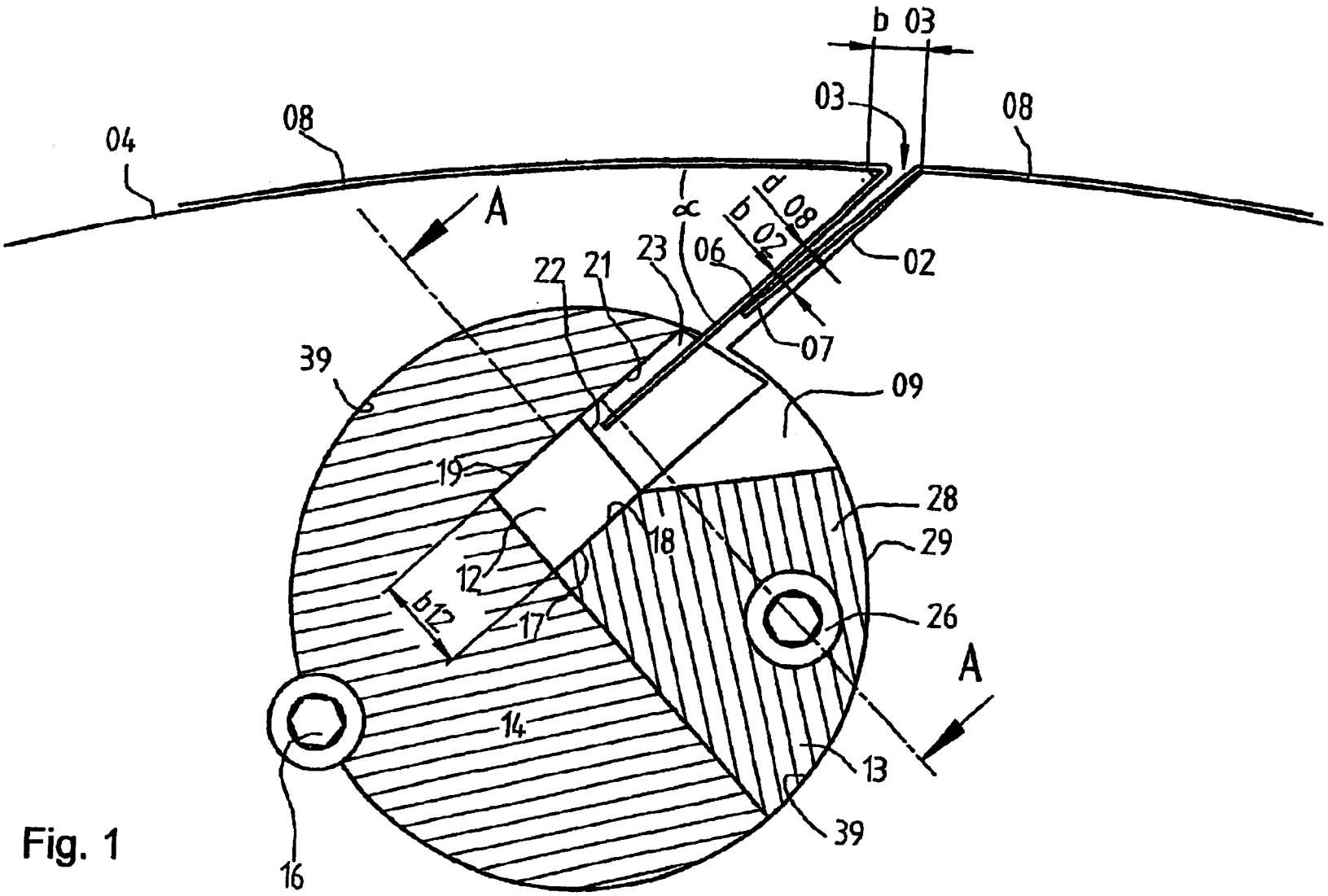
FIG. 1, a schematic representation of a device for the registry-stable placement of a packing on a cylinder in accordance with the present invention, FIG. 2, a top plan view of an area of a printing forme with its cutout, FIG. 3, a side elevation view of a register block, and in FIG. 4, a longitudinal section through the device for the registry-stable placement of a packing on a cylinder taken along the line A—A of FIG. 1 and parallel with the cylinder groove.

Referring to FIG. 1, a cylinder 01, for example a forme cylinder 01 of a rotary printing press, has at least one groove 02 on its circumferential surface, with groove 02 extending in an axis-parallel direction. Groove 02 is provided with an opening 03 in the direction toward the shell or circumferential surface 04 of the cylinder 01, which openings 03 and groove 02 is used for receiving the ends 06, 07 of one or of several cylinder packings 08, for example the beveled ends 06, 07 of printing formes 08. In the depicted embodiment the cylinder 01 is structured as a double-width forme cylinder 01, i.e. one in which four printing formes 08 or newspaper pages can be placed next to each other in the longitudinal direction of the cylinder 01 on its barrel or surface 04.

In its interior, the forme cylinder 01 has a recess 09, for example a bore 09, extending in the axis-parallel direction and connected with the groove 02, in which the device for registry-stable placement of a packing 08 on a cylinder 01, in accordance with the present invention, is arranged. The groove 02, as well as the bore 09, can be provided almost continuously over the entire length of the barrel of the cylinder 01. However, it is also possible for two grooves 02, as well as two bores 09, to each extend over essentially half the length of the cylinder barrel and, if desired, to be offset from each other, for example by 180°, in the circumferential direction of the cylinder 01.

In an advantageous manner, the groove 02 is embodied as a narrow slit 02, i.e. a slit 02 of a slit width b02 in the circumferential direction of the cylinder 01, which, in the area of the shell surface 04 of the cylinder 01, is slightly greater than twice the thickness d08 of the printing forme 08, for example, b02=2 mm, and whose opening 03 in the direction toward the shell surface 04 has a width b03 of, for example, b03<3 mm. In respect to the shell surface 04 of the cylinder 01 the narrow slit 02 extends in a secant-like manner, in an advantageous way on the side of the leading end 06 of the printing forme 08, at an acute angle $\alpha$, for example, $20° < \alpha < 50°$.

Figure 2:
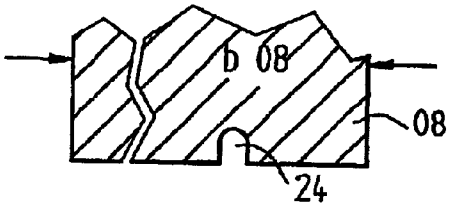
Figure 3:
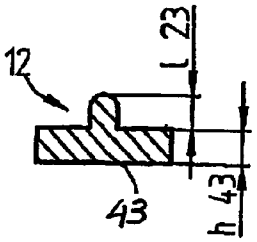
Figure 4:
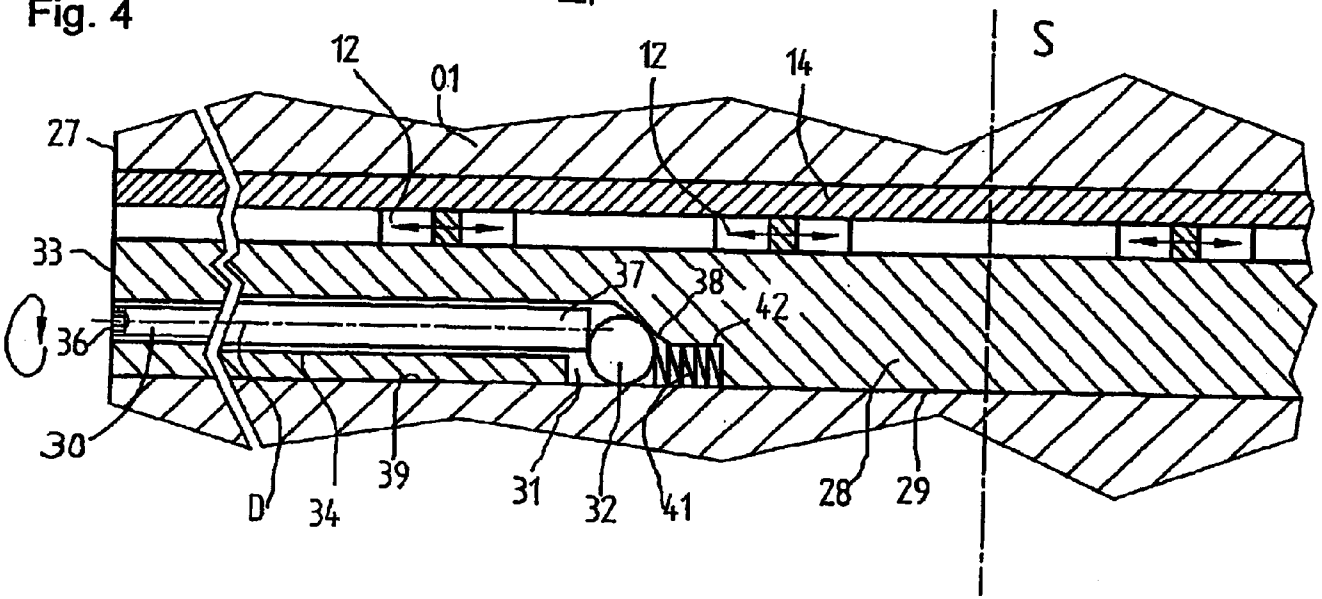

The device for registry-stable placement of a packing 08 on a cylinder, in accordance with the present invention, is arranged in the bore 09 and has at least one register element 12, as seen in FIGS. 1, 3 and 4, which at least one register element may be, for example, a register block 12, and a clamping device 13 that works together with the register block 12 , and which extends in the bore 09 in an axis-parallel direction and parallel with the groove 02. As a rule, several register blocks 12 are arranged along the length of the longitudinal bore 09 and are used to accomplish the register or alignment of, for example, several printing formes 08 which are located next to each other, each of which printing formes 08 has a width b08, as seen in FIG. 2. In this case, the several register blocks 12 are arranged next to each other in the longitudinal direction in the bore 09. The register blocks 12 and the clamping device 13 are arranged, in an preferred manner, on a support strip 14, which support strip 14 is also extending in the longitudinal direction of the bore 09. At its end face, the support strip 14 can have a securing device 16 to secure strip 14 in bore 09 against axial movements and/or pivoting. For example securing device 16 may be a screw or a pin, as seen in FIG. 1.

The register block or blocks 12 and the clamping device 13 are arranged on the support strip 14, or in the bore 09, in such a way, that a first side face 17 of each register block 12 contacts non-positively and acts together with a side face 18 of the clamping device 13 extending in an axis-parallel direction. A second side face 19 of the register block 12, which faces away from the first side face 17, acts non-positively together with a side face 21, which is extending in an axis-parallel direction, of the support strip 14. In the state in which it is not clamped, the register block 12 is arranged so that its position in the support strip 14 can be changed relative to the clamping device 13 and relative to the support strip 14 while remaining parallel with the groove 02. In other words, each register block 12 can slide axially with respect to cylinder 01 in the support strip 14. On its upper face 22 facing the groove 02, the register block 12 has a protrusion 23, for example a pin 23 or a projection, which protrusion 23 is receivable in and thus acts positively together, in respect to an axis-parallel displacement, with a cutout 24 in the leading end 06 of the printing forme 08. The register block 12 can be formed as a one-piece T-element, wherein the shape of the protrusion 23 and that of the cutout 24 are matched so that they fit into each other. The register block 12 has, in an advantageous manner, a width b12, which is greater than the width b02 of the groove 02, as shown in FIG. 1, so that the register blocks 12 are retained in the cylinder bore 09 and are secure against being ejected from bore 09 by the centrifugal forces created, and acting on them in the course of the rotation of the cylinder 01.

The clamping device 13 has an actuating assembly 26, which is operated from the end face 27 of the cylinder 01 and which, as a part of a gear arrangement, converts a rotary movement about an axis D extending in the longitudinal direction of the cylinder 01, or a translatory movement in the axis-parallel direction, into a translatory movement of the side face 18 of the damping device 13 in a direction perpendicular to this axis D; i.e. in a generally circumferential direction. The clamping device actuating assembly 26 can be an eccentric shaft, a camshaft or a profiled shaft of helical cross section, or a threaded spindle, by the use of which a keying connection is produced.

In the preferred embodiment, the clamping device 13 is embodied as a keying connection, which can be operated by operation of the actuating assembly 26, for example as a threaded spindle 30, which extends into the body of the clamping device 13 parallel to the axis of the cylinder 01 and which is accessible from the direction of the end face 27 of the cylinder 01. The actuating assembly 26 substantially consists of a clamping strip 28 having the clamping device side face 18 and having a cutout 31 on a clamping strip outer face 29, facing away from the clamping device side face 18 and with both cutout 31 and face 29 extending in the longitudinal direction. A ball 32 is arranged in the cutout 31, as well as the threaded spindle 30, which spindle 30 is arranged in a bore 34 connecting the cutout 31 and an end face 33 of the clamping strip 28, all as seen most clearly in FIG. 4. The bore 34 is supplied, at least partially, with an interior thread and receives the threaded spindle 30. On its first or exterior end, for example, the threaded spindle 30 has a hexagon socket 36 and, at least in the clamped state, projects with its second end 37 into the cutout 31 and cooperates with the ball 32.

On its side remote from the clamping strip end face 33, the cutout 31 has a wedging face 38, which is inclined toward the clamping strip outer face 29 and which opens in the direction toward the center of the cylinder 01. This wedging, angled face 38 works together with the ball 32 and with a face 39 of the bore 09, fixed on the cylinder 01, in the manner of a key.

It is possible to arrange a different type of pressure element 32 in place of the ball 32, which will work together with the wedging face 38 and with the face 39 of the bore 09, fixed on the cylinder 01. The inclination of the wedging face 38 can also be omitted if the pressure element 32 is embodied in a wedge shape. In the present preferred embodiment, the threaded spindle 30 of the actuating assembly 26, the pressure element 32, and at least one inclined face 38 arranged on the pressure element 32 or the clamping strip 28, together constitute the gear arrangement converting the axial movement into a movement perpendicular to it. It is advantageous in connection with the preferred embodiment that it is possible, by the selection of the thread pitch of the threaded spindle 30 and the inclination of the wedging face 38, to set a fine gear ratio and furthermore, that a frictional connection, effective against the unintentional turning of the threaded spindle 30, can be achieved by use of the screw thread. To insure that in the course of releasing the clamping device 13, the ball 32 will dependably move along the wedging face 38 in the direction of the end face 33 of the clamping strip 28, a spring 41 can be arranged in an axis-parallel extending groove 42 in the wedging face 38.

The arrangement of the cutout 31 and of the pressure element 32 which is pushed off the face 39 of the bore 09, in the longitudinal direction of the cylinder 01 between two register blocks 12 is advantageous. In the preferred embodiment, the cylinder 01 has two clamping devices 13 extending symmetrically in respect to its plane of symmetry S, each of which clamping device 13 is operated from the cylinder's end face. A total of four register blocks 12 are arranged over the length of the cylinder barrel on the continuous support strip 14 in the continuous bore 09. It will be understood that FIG. 4 represents one-half of the symmetrical arrangement.

If the clamping device 13 and the register blocks 12 are not arranged on a support strip 14, but directly in the appropriately shaped recess 09, the second side face 19 of the register blocks 12 acts directly together with the face 39 of the cylinder bore or recess 09 in the clamped state.

The actuating assembly 26 can also be embodied as a camshaft, for example, which is seated without a screw thread in the bore 34. However, the embodiment of the actuating assembly 26 as including a threaded spindle 30, which has a cam on its end projecting out of the cutout 31, is advantageous in regard to a frictional connection against unintentional reversing of the actuating assembly 26. In this case the pressure element 32 and the inclined face 38 can be omitted.

It is essential, inter alia, that the clamping device 13 can be operated from the direction of its end face 33, or at least from outside of the printing area of the barrel, and that when the actuating assembly 26 is operated, the clamping strip 28 is exposed to a movement and/or force component extending essentially perpendicularly in respect to the longitudinal direction of the bore 09; i.e. in the circumferential direction of the cylinder 01, in the course of which movement, the clamping strip 28 maintains the register blocks 12, fixed against an axis-parallel displacement, in a frictionally connected manner between clamping strip 28 and a face 21, fixed on the support strip 14 or the face 39 of the bore 09. In the released state, the position of the register blocks 12 can be changed in the axis-parallel direction, or they can be removed, independently of each other without the entire clamping strip 28 or support strip 14 needing to be axially moved. When the register blocks 12 are being adjusted, the clamping device 13 and the register blocks 12 are moved relative to each other in the longitudinal direction of the cylinder 01.

The clamping device 13, and in particular the actuating assembly 26, can also be operated by an appropriate gear arrangement, for example by bevel gears, that are not specifically represented, from the non-printing edge area direction of the shell surface 04, for example in the immediate vicinity of the cylinder end face 27.

The upper face 22 of the register block 12 which faces the leading end 06 of the printing forme 08 in the circumferential direction, can form a detent which can be set by the height h43 of a base 43 or by a length l23 of the projection 23 of the register block 12. A basic setting in the circumferential register can be selected by the employment of differently dimensioned register blocks 12.

The device for the registry-stable placement of a packing 08 on a cylinder 01, in accordance with the present invention, functions as follows:

In the clamped state, the ball 32 is pressed by the threaded spindle 30 in the direction toward the center of the cylinder 01 between the face 39 of the bore 09 and the inclined face 38, and in this way presses the clamping strip 28 in a direction with at least one component which is normal in respect to the face 39 of the bore 09. Thus the register blocks 12 are frictionally held between the side face 21 of the support strip 14 on the one side, and the side face 18 of the clamping strip 28 of the clamping device 13 on the other side, so that the register blocks 12 are fixed against axis-parallel displacement.

For displacing the device, for example for changing the relative distances of the register blocks 12 in respect to each other, the threaded spindle 30, which can be operated from the end face 27 of the cylinder 01, is rotated in such a way that the frictional connection between the clamping strip 28, the register blocks 12 and the support strip 14 is released, and the register blocks 12 are freed for axis-parallel displacement. For example, the distances between the register blocks 12 can be readjusted by the use of a gauge, which is not specifically represented, and which is inserted into the groove 02. Thereafter the register blocks 12 are again frictionally fixed in place in their new position by turning the threaded spindle 30. With double-width cylinders 01 in particular, i.e. with cylinders 01 on which four printing formes 08 can be placed side-by-side for either a horizontal or a vertical newspaper page, a position change of the register blocks 12 in the longitudinal direction of the cylinder by one-half the width b08 of a packing 08 is, for example, required when resetting the cylinder 01 from use with simple printing formes 08 to use with so-called panorama plates of almost twice the width.

An exchange, the removal, or the additional equipping of the device with register blocks 12 is also possible in a simple manner in that, following the release of the threaded spindle 30, either the register blocks 12 are pushed out of the end of the device or, following the additional release of the support strip securing device 16, the entire device, consisting at least of the clamping strip 28 and the register blocks 12, is pulled out of the bore 09 from the end of the cylinder 01.

While a preferred embodiment of a device for providing a cylinder with a registry-stable packing in accordance with the present invention has been set forth fully and completely hereinabove, it will be apparent to one of skill in the art that various changes in, for example, the type of packings or plates placed on the cylinder, the overall size of the cylinder, and the like could be made without departing from the true spirit and scope of the present invention which is accordingly to be limited only by the following claims.

What is claimed is:

1. A device for placing at least one register-stable packing on a cylinder of a rotary printing press comprising:

a cylinder barrel having a longitudinal axis and an end face;

at least a first register block supported for movement in said cylinder barrel in a longitudinal direction;

a clamping device useable to secure said at least first register block in a desired position in said cylinder barrel, said damping device having a clamping point within said cylinder barrel, said clamping point being useable to fix said at least first register block in place with respect to a position change in said longitudinal direction; and means for actuating said clamping device from said cylinder barrel end face.

2. The device of claim 1 wherein a packing placed on said cylinder barrel has a packing width and further wherein said at least first register block is continuously changeable in said longitudinal direction through a distance equal to at least one half of said packing width.

3. The device of claim 2 wherein said cylinder barrel has a barrel length, said barrel length being at least equal to twice said packing width.

4. The device of claim 2 wherein said cylinder barrel has a barrel length, said barrel length being at least equal to four times said packing width.

5. The device of claim 4 wherein said distance over which said at least one register block is changeable Is equal to one half of said barrel length.

6. The device of claim 1 further including a second register block in said cylinder barrel, said first and second register blocks being arranged adjacent each other in said longitudinal direction.

7. The device of claim 6 further including at least a second clamping device in said cylinder barrel.

8. The device of claim 1 further including a plurality of said register blocks, said plurality of said register blocks being operable by said clamping device.

9. The device of claim 1 wherein said clamping device is moveable in said longitudinal direction and further wherein longitudinal movement of said register block can be accomplished independently of longitudinal movement of said clamping device.

10. The device of claim 1 further including a clamping strip in said clamping device, said clamping strip acting on said at least one register block, and an actuating assembly, said actuating assembly being operable to move said clamping strip in a direction perpendicular to said longitudinal direction against and away from said at least one register block.

11. The device of claim 10 wherein said actuating assembly includes a threaded spindle extending in said longitudinal direction, said threaded spindle being useable to move said clamping strip in said direction perpendicular to said longitudinal direction.

12. The device of claim 1 further including a recess in said cylinder barrel, said recess extending in said longitudinal direction, and a groove extending between said recess and a shell surface of said cylinder barrel, said groove receiving a leading end and a trailing end of a packing placed on said cylinder barrel.

13. The device of claim 12 wherein said packing leading end has a cutout and further wherein said at least one register block has a protrusion, said protrusion being receivable in said cutout.

14. The device of claim 12 wherein said groove extends at an acute angle between said recess and said shell surface and further wherein said groove has a width at said shell surface, said width being less than 3 mm.

15. The device of claim 12 wherein said register block has a register block width and said groove has a groove width, said register block width being greater than said groove width.

16. A device for placing at least one register-stable packing on a cylinder of a rotary printing press comprising:

a cylinder barrel having a longitudinal direction;

at least a first register block supported for movement in said cylinder barrel in said longitudinal direction;

a width defined by a packing placeable on said cylinder barrel, said packing width extending in said longitudinal direction; and means for continuously changing a position of said at least first register block in said longitudinal direction in said cylinder barrel over a length, said length being at least one half of said width.

17. The device of claim 16 further including a clamping device useable to secure said at least first register block in a desired position in said cylinder barrel, said clamping device having a clamping point within said cylinder barrel, said clamping point being useable to fix said at least first register block in place with respect to a position change in said longitudinal direction.

18. The device of claim 17 further including a plurality of said register blocks, said plurality of said register blocks being operable by said clamping device.

19. The device of claim 17 wherein said cylinder barrel has an end face and further wherein said clamping device is actuated from said cylinder barrel end face.

20. The device of claim 17 wherein said clamping device is moveable in said longitudinal direction and further wherein longitudinal movement of said register block can be accomplished independently of longitudinal movement of said clamping device.

21. The device of claim 17 further including a clamping strip in said clamping device, said clamping strip acting on said at least one register block, and an actuating assembly, said actuating assembly being operable to move said clamping strip in a direction perpendicular to said longitudinal direction against and away from said at least one register block.

22. The device of claim 21 wherein said actuating assembly includes a threaded spindle extending in said longitudinal direction, said threaded spindle being useable to move said clamping strip in said direction perpendicular to said longitudinal direction.

23. The device of claim 16 further including a second register block in said cylinder barrel, said first and second register blocks being arranged adjacent each other in said longitudinal direction.

24. The device of claim 23 further including at least a second clamping device in said cylinder barrel.

25. The device of claim 16 further including a recess in said cylinder barrel, said recess extending in said longitudinal direction, and a groove extending between said recess and a shell surface of said cylinder barrel, said groove receiving a leading end and a trailing end of a packing placed on said cylinder barrel.

26. The device of claim 25 wherein said packing leading end has a cutout and further wherein said at least one register block has a protrusion, said protrusion being receivable in said cutout.

27. The device of claim 25 wherein said groove extends at an acute angle between said recess and said shell surface and further wherein said groove has a width at said shell surface, said width being less than 3 mm.

28. The device of claim 25 wherein said register block has a register block width and said groove has a groove width, said register block width being greater than said width.

29. The device of claim 16 wherein said cylinder barrel has a barrel length, said barrel length being at least equal to twice said packing width.

30. The device of claim 16 wherein said cylinder barrel has a barrel length, said barrel length being at least equal to four times said packing width.

31. The device of claim 30 wherein said distance over which said at least one register block is changeable is equal to one half of said barrel length.

* * * * *